United States Patent [19]

Strauss

[11] 4,066,535

[45] Jan. 3, 1978

[54] METHOD AND APPARATUS FOR THE CLASSIFICATION OF FINE MATERIAL FROM A STREAM OF MATERIAL IN A CIRCULATING AIR CLASSIFIER

[75] Inventor: Werner Strauss, Bochum, Germany

[73] Assignee: Klockner-Humboldt-Deutz Aktiengesellschaft, Germany

[21] Appl. No.: 694,838

[22] Filed: June 10, 1976

[30] Foreign Application Priority Data

June 19, 1975 Germany ..... 2527340

[51] Int. Cl.[2] ..... B07B 4/02

[52] U.S. Cl. ..... 209/139 A; 209/148

[58] Field of Search ..... 209/139 A, 148, 134, 209/135

[56] References Cited

U.S. PATENT DOCUMENTS

| | | | |
|---|---|---|---|
| 1,266,075 | 5/1918 | Spitz | 209/135 |
| 2,707,314 | 5/1955 | Horth | 209/135 X |

FOREIGN PATENT DOCUMENTS

| | | | |
|---|---|---|---|
| 184,870 | 8/1972 | United Kingdom | 209/148 |

*Primary Examiner*—William A. Cuchlinski, Jr.
*Attorney, Agent, or Firm*—Hill, Gross, Simpson, Van Santen, Steadman, Chiara & Simpson

[57] ABSTRACT

Method and apparatus for classifying articles of varying size from a stream of particulate material in which the stream is subjected to centrifugal forces to provide an annular dispersion, and a stream of air is directed substantially perpendicular through the dispersion to aid in separating the fines from the coarser particles.

6 Claims, 1 Drawing Figure

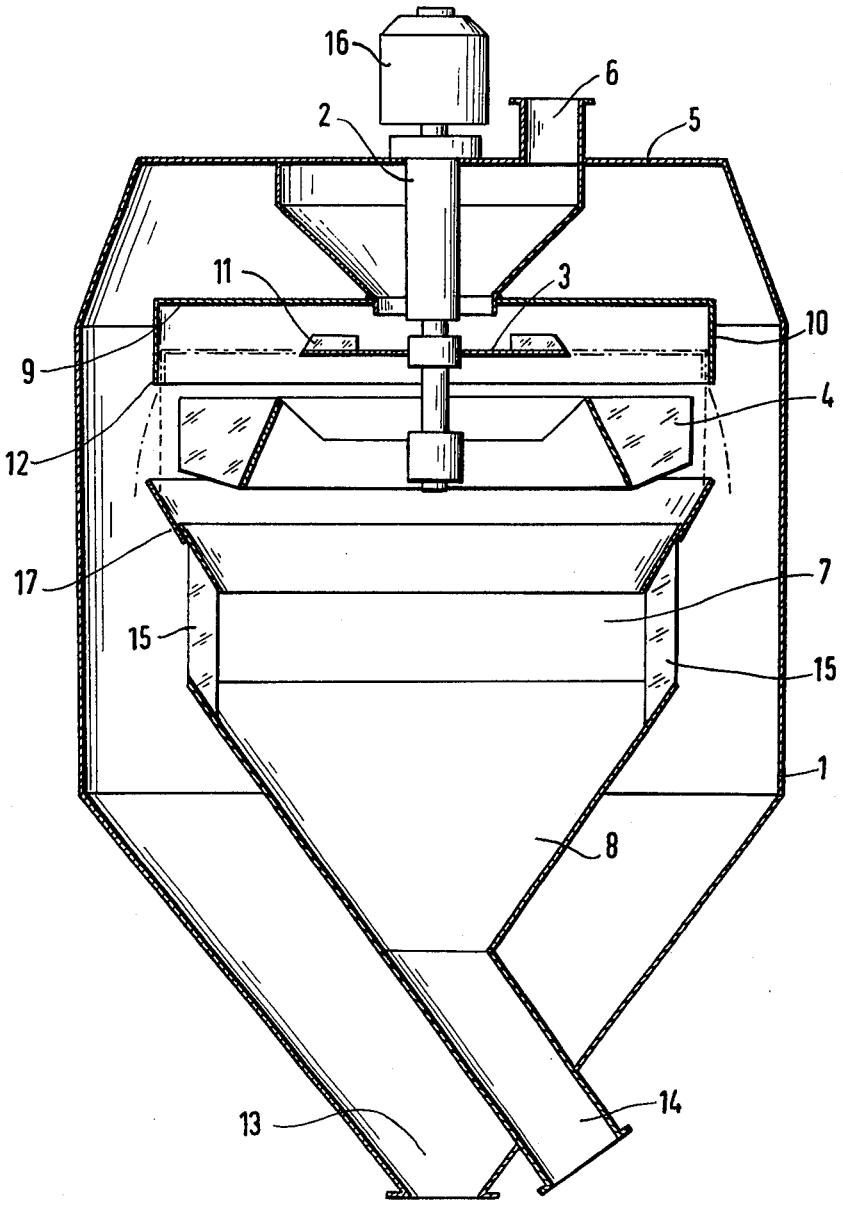
16
6
2
5
11
3
10
9
4
12
17
7
15
15
1
8
13
14

METHOD AND APPARATUS FOR THE CLASSIFICATION OF FINE MATERIAL FROM A STREAM OF MATERIAL IN A CIRCULATING AIR CLASSIFIER

BACKGROUND OF THE INVENTION

Field of the Invention

This invention is in the field of circulating air classifiers of the type having an inner and outer housing concentric with each other, and employing centrifugal spreading means to propel the stream of material into the inner or outer housing, depending upon the mass of the particles.

Description of the Prior Art

Classifiers which employ concentric inner and outer housings, together with a circulating air system for separating fine particles from coarser particles are well known in the art. In such classifiers, the material is supplied to a rotating spreader plate and distributed by the spreader plate perpendicular to the axis of the housings. Above the spreader plate, there is provided a ventilator which produces an air current passing through the fine material as well as the grading chamber of the classifier. The current of air produced by the ventilator is directed through the grading chamber parallel to the axis of the classifier and flows through the material centrifugally propeled perpendicular to the axis of the classifier by the spreader plate, pulling the fine material upwardly and delivering the fine material suspension into a fine material chamber from where particles are dischared through discharge members. In the case of such classifiers wherein the fine material is lifted upwardly against the force of gravity and must be guided through the wall of the chamber into the fine material chamber, there are substantial difficulties in transporting portions of fine material with larger granule diameters, for example, up to 3 mm. out of the grading chamber to the collection zone, as the air speeds must rise substantially in order to accommodate higher granule diameters. For example, with a classifier which separates material to a 1 mm. granule size, the air speeds must be tripled in order to sift out particles from material with a diameter up to 3 mm. This means increased rates of rotation for the fan or blower, coupled with larger drive units, and larger blade diameters for the fan or blower, whereby the classifier as a whole is made larger, more expensive and uneconomical.

SUMMARY OF THE INVENTION

The present invention provides a method for the classification of fine material from larger diameter material which makes it possible to effect a separation even with low speeds and small fan or blower capacity. In the present invention, the stream of material is directed in a cylindrical or conical suspension in the direction of the axis of the classifier, and is subjected to a current of air which is substantially perpendicular to the dispersion axis to thereby improve the separation of fine material from coarse material. With this system, particles of material with granule diameters smaller than 3 mm. are deflected by the auxiliary stream of air from the vertical direction which extends parallel to the axis of the classifier. A small deflection is sufficient to cause these fine particles to be directed into the fine material chamber which is located between the inner and outer housings of the classifier. The particles of material in the present process are not carried by an air current contrary to the effects of gravity in an updraft, for which purpose high air speeds are necessary. Instead, the method of the present invention may use relatively small fans or blowers, and small classifier dimensions to separate fine materials having granule diameters up to 3 mm. from a stream of larger materials containing such fine particles.

The annular dispersion according to the present invention is formed to be substantially coextensive with the inner wall of the inner housing, and is formed above the fan or blower means. By this means, the material suspension drops down as close as possible to the inner wall of the inner housing, so that a small stream of circulating air is sufficient to deflect the particles of fine material from the vertical direction and permit them to drop into the fine material chamber surrounding the inner housing. In addition, it is possible with the apparatus of the present invention to adjust for different degrees of separation by control of the rate of rotation of the drive and the speed of the air flow.

The apparatus of the present invention provides a circulating air classifier which has an inner housing and an outer housing concentric with each other. A fan or blower is provided coaxially with the housings. A centrifugal spreading means is provided above the fan or blower to propel the stream of material radially outwardly into a cylindrically shaped dispersion which descends through gravity into the effective area of the fan or blower.

In the preferred form of the present invention, the scattering or spreading device is surrounded coaxially with and spaced from a cylindrically shaped baffle. This strucure is particularly advantageous when using scattering or spreading devices which are rotary mixing tables or turntables and are provided with peripheral vanes. The material centrifuged off the rotary mixing table or turntable is deflected by the baffle wall and drops independently of the material particle size from the inner surface of the baffle wall as a uniform annular dispersion. Consequently, there is a continuous dispersion of material through which the circulating air which is directed perpendicularly to the dispersion may flow, and a uniform deflection of the finer particles of material is attained.

The baffle wall is preferably constructed as a hood and is open toward the bottom, so that larger particles of material are prevented from being thrown into the fine material chamber. The outer wall of the hood extends approximately coextensively with the inner wall of the inner housing so that the inner diameter of the hood is only slightly smaller than the inner diameter of the housing, and the annularly shaped material suspension decreases from the lower edge of the baffle hood near the inner wall of the inner housing. Thus, a small stream of air is sufficient to deflect the finer particles of material from their vertical drop and to carry them into the fine material chamber of the outer housing.

In a particularly preferred form of the invention, the inner housing is provided with an inlet in the vicinity of the fan or blower consisting of a wall in the form of a truncated cone. Accordingly, the inner housing may be relatively small in diameter with the wall under the fan or blower in the area of the lower edge of the baffle having a larger diameter, so that the coarse particles of material which are not deflected from the stream of air or are only slightly deflected, drop into the larger particle chamber of the air housing. Preferably, the conical sleeve is constructed to be slidable longitudinally. In this way, it is possible with a constant rate of rotation of the fan or blower to alter the effective diameter through a simple shifting of the conical sleeve. Thus, for example, a coarse adjustment of the separating section may take place through a shifting of the conical sleeve while the fine adjustment is placed through a change in the rate of rotation of the fan or blower.

DESCRIPTION OF THE PREFERRED EMBODIMENTS

A particularly preferred embodiment of the present invention is illustrated in the single FIGURE of the drawing which consists of a vertical cross-sectional view of an improved classifier produced according to the present invention.

The circulating air classifier shown in the drawings has a vertical axis and includes an outer housing 1, a rotary mixing table or turntable 3 carried by a shaft 2, the lower end of the shaft carrying an impeller means such as a fan or blower 4. Above the rotary mixing table 3 there is provided a material supply hopper 6 which extends through a cover 5 of the outer housing 1, and is spaced from the shaft 2. Below the fan 4 there is an inner housing 7 which has funnel-shaped collecting housing 8 for the coarser particles. The area between the inner housing 7 and an outer housing 8 is provided with air conducting blades 15 so that the inner housing 7 is in open fluid communication with the outer housing 1. The collecting housing 8 is provided with a discharge pipe 14 and other withdrawal members (not shown). The outer housing 1 has a discharge means 13, together with suitable mechanical devices for transporting the collected dust.

Surrounding the rotary mixing table 3 and coaxial therewith is a cylindrical baffle hood 9 which is stationarily connected with the inlet 6. However, the hood may also rotate with the mixing table 3. The baffle hood 9 has an open lower end which terminates shortly above the upper edge of the fan 4. The diameter of the baffle wall 10 of the hood 9 is less than the largest diameter of the inner housing 7. The inner housing 7 has an inlet end in the area of the fan 4 which is in the form of a wall widening into a truncated cone which exends beyond the inner diameter of the baffle wall 10 of the baffle hood 9. The conical sleeve or cone-shaped shell may be shifted longitudinally, as by means of a telescoping relationship, so that the diameter of the inner housing 7 in this vicinity may be altered.

The operation of the illustrated device is as follows. A continuous stream of material is delivered to the inlet 6 as, for example, from a comminuting device. The stream of material is delivered through the inlet 6 onto the rotary mixing table 3 and is centrifuged therefrom by means of the peripheral vanes 11 on the rotary table 3. The particles strike against the inner wall 10 of the baffle hood 9. From the lower edge 12 of the baffle hood 9, the material drops in a uniformly distributed cylindrically shaped suspension by the effect of gravity, and arrives at the effective area of the fan or blower 4 which is coupled to the shaft 2. The current of air produced by the fan or blower 4 is directed perpendicularly to the axis of the classifier through the material suspension and carries the fine particles of material beyond the inner housing 7 and into the space between the inner housing 7 and the outer housing 1. The fractions of fine material are separated off within the outer housing 1 and withdrawn through a discharge pipe 13.

The coarse material parts are not influenced greatly by the transverse flow of air and are therefore delivered to the inner housing 7 and thence into the collector housing 8 from which they are discharged through a discharge pipe 14. The air flowing into the outer housing 1 is drawn through the air-conducting blades 15 of the fan or blower 4 and flows through the inner housing 7 in an upwardly directed current to thereby circulate to the fan or blower 4.

If the separation desired between the coarse and fine materials is to be shifted to larger granule diameters, then the rate of rotation of the fan or blower is increased by adjusting the speed of the blower motor 16 so that a stronger current of air deflects coarser particles of material from the suspension into the outer housing 1. If the separating action is to be shifted in the other direction, namely, to accommodate only smaller granule diameters, then the rate of rotation of the fan or blower is reduced so that some of the finer particles of material drop into the inner housing 7. The shifting of the dividing line between the coarse and finer particles may also be accomplished with a constant rate of rotation by manipulation of the conical sleeve of the inner housing 7 to catch more of the coarser particles. It is, of course, possible in the course of the present invention to adjust both the disposition of the conical inlet to the inner housing 7 and the speed of rotation of the fan or blower 4, providing a coarse adjustment by changing the length of the conical sleeve inlet to the inner housing 7 and achieving a fine regulation by means of changing the speed of the blower motor 16.

It should be evident that various modifications can be made to the described embodiments without departing from the scope of the present invention.

I claim as my invention:

1. A classifier for classifying particulate materials comprising:

means defining an outer housing, means defining an inner housing spaced from said outer housing and concentric therewith, inlet means for introducing a stream of particles through said outer housing, a horizontally disposed rotating spreading means receiving said stream and arranged to centrifugally propel the particles outwardly, baffle means substantially surrounding said spreading means and positioned to be impacted by the particles propelled by said spreading means to form a falling annular dispersion of particles, said baffle being substantially coextensive with the inlet to said housing, an impeller located below said spreading means and arranged to direct air radially through said dispersion to thereby separate finer particles from coarser particles, and means for separately collecting said finer particles and said coarser particles.

2. A classifier according to claim 1 in which said baffle means has a diameter less than the diameter of said inner housing.

3. A classifier according to claim 1 in which said impeller means is located between said baffle and said inlet to said inner housing.

4. A classifier according to claim 3 in which the inlet to said inner housing is in the form of a truncated cone.

5. A classifier according to claim 4 in which said truncated cone is made up of a plurality of pieces longitudinally movable with respect to each other.

6. A classifier according to claim 3 in which said impeller means has a diameter less than that of said baffle.

* * * * *